US007198221B2

(12) United States Patent
Betti et al.

(10) Patent No.: US 7,198,221 B2
(45) Date of Patent: Apr. 3, 2007

(54) DEVICE FOR CONTROLLING THE DISCHARGING OF ROLLS FROM A REWINDER AND REWINDER COMPRISING SAID DEVICE

(75) Inventors: Giulio Betti, Lucca (IT); Angelo Benvenuti, Lucca (IT); Roberto Morelli, Lucca (IT)

(73) Assignee: Fabio Perini S.p.A., Lucca (IT)

( * ) Notice: Subject to any disclaimer, the term of this patent is extended or adjusted under 35 U.S.C. 154(b) by 52 days.

(21) Appl. No.: 10/481,607

(22) PCT Filed: Jun. 21, 2002

(86) PCT No.: PCT/IT02/00413

§ 371 (c)(1),
(2), (4) Date: Dec. 22, 2003

(87) PCT Pub. No.: WO03/002439

PCT Pub. Date: Jan. 9, 2003

(65) Prior Publication Data

US 2004/0178295 A1 Sep. 16, 2004

(30) Foreign Application Priority Data

Jun. 29, 2001 (IT) ..... FI2001A0120

(51) Int. Cl.
*B65H 19/22* (2006.01)

(52) U.S. Cl. ..... 242/533.2; 242/533.3; 242/534

(58) Field of Classification Search ..... 242/533, 242/533.2, 533.3, 534
See application file for complete search history.

(56) References Cited

U.S. PATENT DOCUMENTS

| | | | | |
|---|---|---|---|---|
| 3,598,251 | A * | 8/1971 | Sieurin | 414/731 |
| 4,277,032 | A * | 7/1981 | Alberto et al. | 242/523.1 |
| 4,842,209 | A * | 6/1989 | Saukkonen | 242/527.3 |
| 5,022,597 | A * | 6/1991 | Morizzo | 242/413.5 |
| 5,242,525 | A * | 9/1993 | Biagiotti | 156/357 |
| 5,257,748 | A * | 11/1993 | Morizzo | 242/527 |
| 5,759,326 | A | 6/1998 | Vigneau | |

FOREIGN PATENT DOCUMENTS

| | | |
|---|---|---|
| EP | 0 387 214 A2 | 9/1990 |
| EP | 0 387 214 A3 | 9/1990 |
| EP | 0 524 158 A1 | 1/1993 |
| EP | 0 867 392 A1 | 9/1998 |
| SU | 973464 | 11/1982 |
| SU | 1211196 A | 2/1986 |
| WO | WO 94/21545 A1 | 9/1994 |
| WO | WO 99/29480 A1 | 6/1999 |

* cited by examiner

*Primary Examiner*—Emmanuel Marcelo
*Assistant Examiner*—Sang Kim
(74) *Attorney, Agent, or Firm*—Breiner & Breiner, L.L.C.

(57) ABSTRACT

A description is given of a device for controlling the discharging of rolls (R) from a rewinder, comprising a rolling surface (11) on which the rolls roll as they leave said rewinder and a member (17) able to rotate about an axis parallel to said rolling surface and perpendicular to the direction of discharge of the rolls. During operation, the rotatable member always rotates in the same direction about its own axis. It is provided with at least two roll retaining surfaces defining, with the rolling surface, a roll containing zone.

30 Claims, 3 Drawing Sheets

DEVICE FOR CONTROLLING THE DISCHARGING OF ROLLS FROM A REWINDER AND REWINDER COMPRISING SAID DEVICE

DESCRIPTION

1. Technical Field

The present invention relates to a device for controlling the discharging of rolls of web material produced by a rewinder which discharges them onto a rolling table or surface.

The invention also relates to a rewinder for producing rolls of web material, for example, and in particular (but not exclusively), rolls of paper material, such as toilet paper, tissue paper or the like, comprising a device for controlling the discharging of the rolls.

2. State of the Art

The paper converting industry uses machines known as reminders or winders which take large-diameter reels of web material and turn them into rolls of wound web material which are later cut up into small rolls of finished product and sent for packaging, such as for example rolls of toilet paper, paper towels or the like.

So-called peripheral rewinders wind the web material into rolls in a winding cradle which is normally defined by three winding cylinders, between which the developing roll is held and kept rotating by the rotation of the winding cylinders. An example of a peripheral rewinder of this type is described in WO-A-9421545.

Once the winding of the roll is completed, that is once the required amount of material has been wound, the roll is discharged from the winding cradle in a variety of ways. Precisely how the roll is discharged from the winding cradle is not important for the purposes of the present description. What is important is the fact that the discharged rolls must be slowed and controlled so that they reach the machines downstream of the rewinder at a suitable speed and at suitable intervals, the point being that the rolls are discharged from the winding cradle of the rewinder at a speed proportional to the winding speed, that is to the speed at which the web material is fed to the rewinder. This speed is greater than that at which the rolls must be fed to stations further downstream. As they leave the winding cradle of the rewinder, the rolls must therefore be slowed to an appropriate speed at which they can be fed to the subsequent stations.

To this end, a rolling surface is provided at the outlet of the rewinder, onto which the rolls are discharged and on which a device is positioned to control the discharging of the rolls. At present, these devices employ a concave-shaped member mounted so as to pivot about an axis perpendicular to the direction of discharge of the rolls and parallel to the discharge surface. The moveable member is held in a position such as to accept the single roll discharged from the rewinder. Once this roll touches the moveable member, the latter is pivoted by a special actuator to allow the roll to continue its movement toward the stations further downstream. Once the roll has left the zone in which it was stopped by the moveable member, the latter returns by an inverse movement to the position in which it awaits the next roll. The reciprocating movement is supplied by a cylinder-and-piston actuator of hydraulic or preferably pneumatic type.

If the roll is so compact as to be very rigid and/or the speed at which it is expelled from the rewinder is very high, there is a risk that as the roll bumps into the moveable member, it will bounce back, causing problems for efficient operation of the entire converting line.

To prevent bouncing of the roll, coverings of soft material are sometimes applied to the moveable member. However, these increase the friction between the roll and the bump surface, which means that there is a greater risk of damage to the roll. Ideally, friction should instead be reduced to a minimum between the roll and the moveable member to avoid damaging the web material wound on the roll, especially along the lines of perforations present on said web material.

In addition, the fact that the moveable member has to be returned each time to the position in which it can await the next roll, by an inversion of the movement, makes it impossible to increase the rate of production above certain limits. Both the necessity of repositioning the moveable member and the actual type of actuator, with its relatively long reaction times, increase the total time needed to reposition the moveable member before it can receive the next roll.

OBJECTS AND SUMMARY OF THE INVENTION

It is an object of the present invention to provide a device of the abovementioned type that will overcome the drawbacks of the prior art.

In particular, it is an object of the present invention to provide a device that will enable high production rates to be achieved.

These and other objects and advantages, which will become clear to those skilled in the art on reading the following text, are achieved in substance with a device for controlling the discharging of rolls from a rewinder, comprising: a rolling surface (sloping gently downwards) on which the rolls roll as they leave said rewinder; a member able to move about an axis parallel to said rolling surface and perpendicular to the direction of discharge of the rolls from said rewinder; and an actuator for controlling the movement of said moveable member. Characteristically, according to the invention during operation, said moveable member always rotates in the same direction about its own axis, and possesses at least two roll retaining surfaces defining, with the rolling surface, a roll containing zone. In this way, since the movement of the moveable member does not have to be reversed, the rate at which rolls can arrive at the member can be greatly increased. Also, problems due to bouncing of the rolls on the moveable member are eliminated because of the presence of the two surfaces defining a roll retaining and containing volume.

The movement of the moveable member may be a discontinuous movement, that is intermittent, or continuous with a speed normally modulated to suit the frequency of arrival of the rolls or logs from the rewinder and/or slowing requirements dependent upon the characteristics of the roll. The fact that the movement is rotational (continuous or intermittent) and so is permanently in the same direction, rather than oscillating movement, makes the device capable of running at very high production rates. Moreover the presence of two roll containing surfaces ensures that the rolls cannot move backwards by bouncing on the downstream containing surface. In practice the pair of containing surfaces define a sort of V which, when upside down, that is open toward the roll rolling surface, forms with the latter a volume in which the roll coming from the upstream rewinder is trapped and cannot bounce backwards. It dissipates its kinetic energy by successively bumping and sliding on the surfaces until it is essentially static. In this condition the roll can then continue its journey toward the downstream station, for example a gluing machine, due to continued rotation of the moveable member and by rolling spontaneously on the sloping rolling surface.

In one practical and especially advantageous embodiment of the invention, the device is provided with means for detecting the arrival of a roll on the rolling surface. In addition, the actuator that operates the moveable member is controlled in such a way that, the moveable member is moving at a controlled speed about the axis of rotation when said roll contacts the moveable member. By this means the violence with which the roll bumps against the moveable member is reduced, and any bouncing of the roll against the surface of the moveable member is reduced as well.

In order correctly to synchronize the movement of the moveable member with the arrival of the individual rolls, a detector may be provided at a point along the rolling surface over which the rolls travel. This detector, which may be a photoelectric cell for example, detects the passage of the roll and, via a programmable control unit, initiates the movement of the moveable member in advance of the arrival of the roll against said member. The moveable member will be appropriately and advantageously equipped with a position sensor interfaced with the same control unit.

As an alternative, the signal of the arrival of the roll may be supplied directly by the rewinder, that is by the control unit of the latter. On the basis of the speed of output of the rewinder, that is the rate of production and hence expulsion of rolls, adjustment to the speed of rotation of the moveable member can also be determined, and this speed may, as mentioned earlier, be a continuous rotation of constant speed or more frequently variable speed in time, or it may be intermittent rotation.

In practice, the moveable member may be controlled in such a way that when the incoming roll contacts a first of said at least two surfaces, the other of said surfaces is in a position such as to obstruct the backward movement of the roll caused by its bouncing off the first surface. The backward movement caused by the bouncing of the roll is thus immediately blocked. This condition is achieved by appropriate selection of the angle of the two surfaces. The surfaces may be flat, but this is not essential. Other possibilities are curved concave or convex surfaces. Whatever the shape of the surfaces, in each of them a plane may nonetheless be identified, for example a tangential plane at the center point of a convex surface. The two surfaces thus always define two convergent planes forming an obtuse angle in which is the roll containing zone. This angle may be between 100 and 150° and preferably between 110 and 140°, for example approximately 130°.

In theory the moveable member may have only one pair of roll retaining surfaces. Preferably, however, it will have a plurality of pairs, preferably three pairs, of roll retaining surfaces, so that the moveable member does not have to execute a complete revolution between one roll and the next. This further increases the speed at which the device can operate.

Other advantageous characteristics of the device according to the invention are indicated in the appended claims.

BRIEF DESCRIPTION OF THE DRAWINGS

A clearer understanding of the invention will be gained from the description and the accompanying drawing, which shows a practical but non-restrictive embodiment of the invention. More particularly, in the drawing.

DETAILED DESCRIPTION OF THE PREFERRED EMBODIMENT OF THE INVENTION

Figure 1:
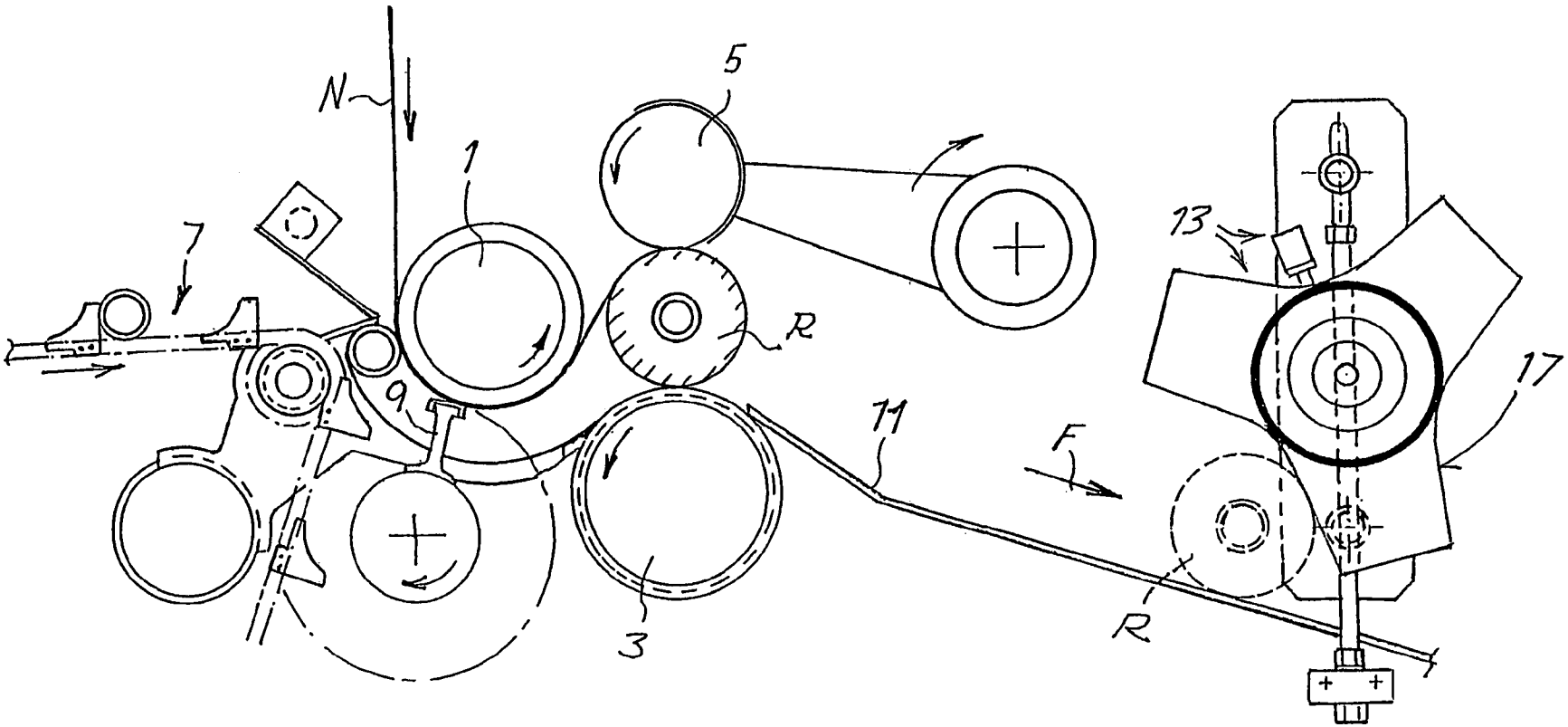
FIG. 1 shows a schematic side view of a rewinder, showing only the roll winding and discharging members.

FIG. 1 is a schematic view of a rewinder, showing only those parts necessary for an understanding of the present invention. The rewinder comprises a set of three cylinders 1, 3, 5 between which the rolls R of web material N are formed in sequence. The web material, such as paper, is fed around the winding cylinder 1. The reference number 7 denotes a conveyor supplying tubular cores of board or the like around which the rolls R are formed, and reference number 9 a device for cutting or tearing the web material N when winding is completed. The structure of the rewinder shortly illustrated here is only an example of the peripheral rewinder. It must be understood that the present invention can be combined with any rewinder, particularly of the peripheral type with winding cylinders, but also other types.

Each completed roll R is expelled from the winding cradle defined by the three rollers 1, 3, 5 by modifying the peripheral velocity of rollers 3 and/or The expelled roll passes onto the rolling surface 11, at an appropriate position along which is a device for controlling the discharging of the rolls. This device is labelled 13 as a whole and specifically forms the subject matter of the present invention.

Figure 2:
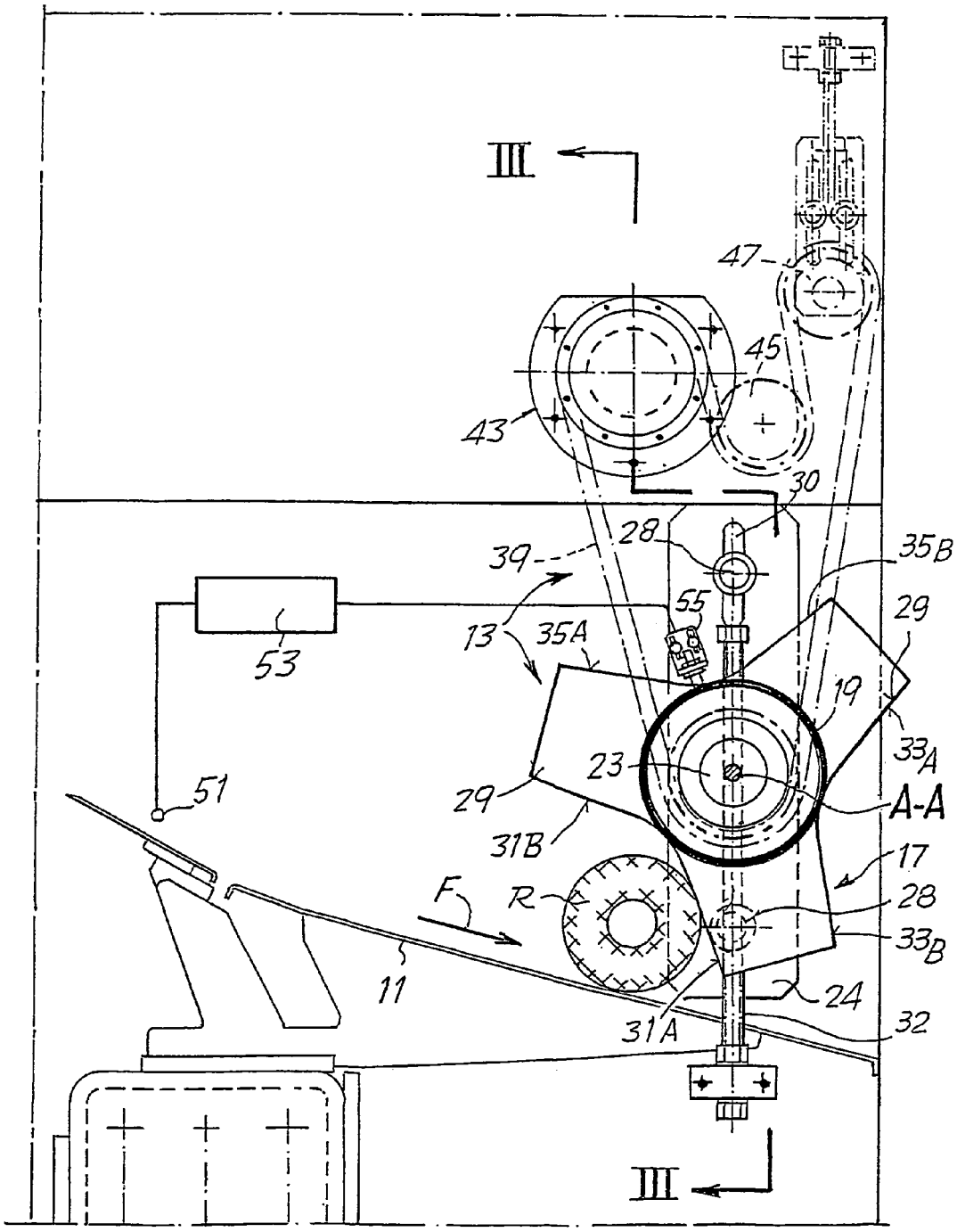
FIG. 2 shows an enlarged side view of the device for controlling the discharging of the rolls.
Figure 3:
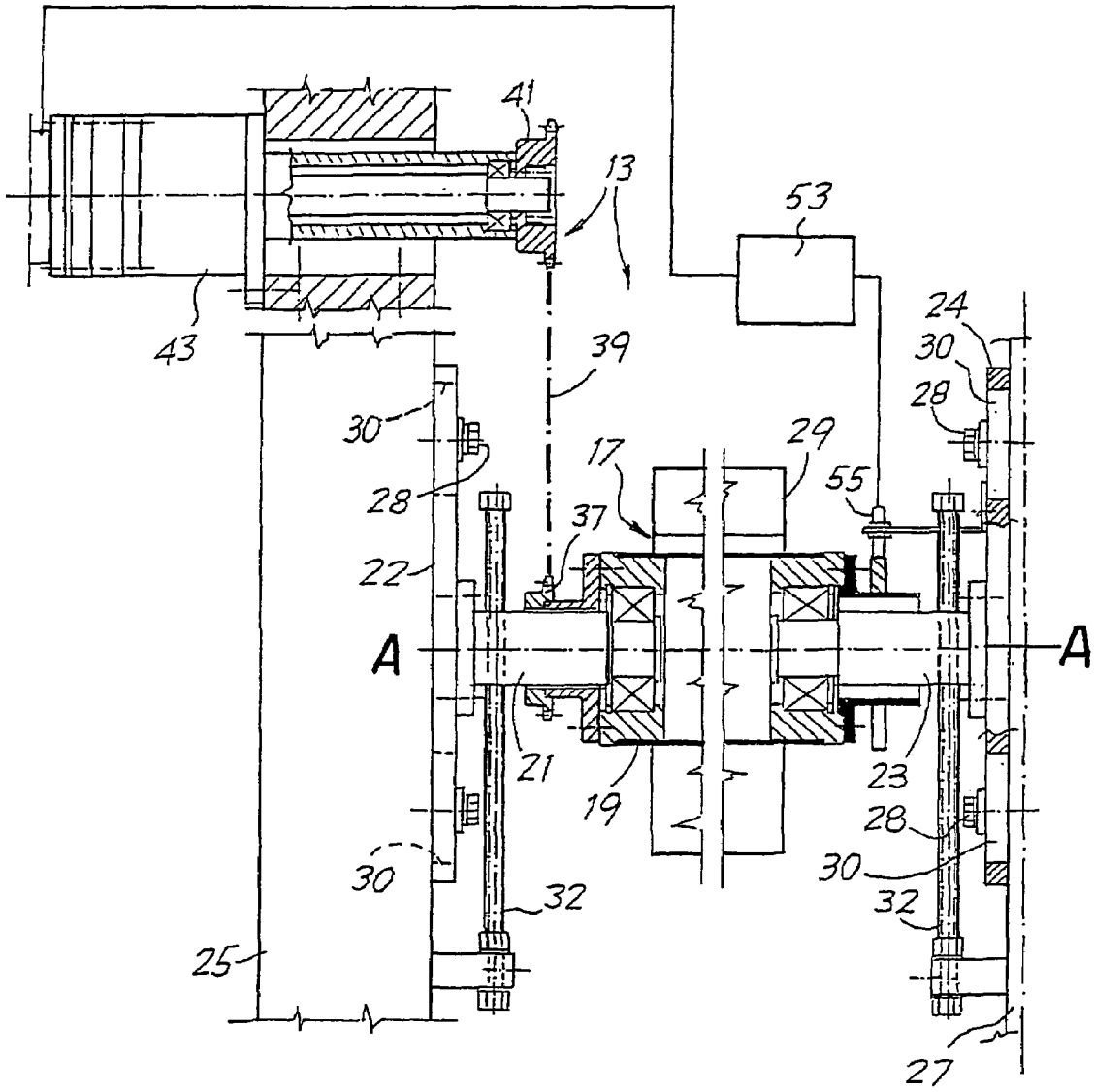
FIG. 3 shows a cross section taken on III—III as marked in FIG. 2.

As can be seen in greater detail in FIGS. 2 and 3, the device 13 comprises a moveable member 17 rotating about an axis A—A parallel to the rolling surface 11 and perpendicular to the direction F in which the rolls R roll. In the constructional example illustrated, the moveable member 17 consists of a tubular part 19 supported by two journals 21, 23, each fixed to its own plate 22, 24 which is in turn fastened to a corresponding side wall 25, 27 (see in particular FIG. 3). Each plate 22, 24 is fastened to the corresponding side wall 25, 27 by a pair of screws 28 that fit into slots 30 (see FIG. 2) in the plates 22, 24. This allows the height of the axis A—A to be adjusted. This adjustment is done manually by means of threaded bars 32 engaged in threaded holes in the journals 21, 23, perpendicular to the axes of the journals themselves.

Fixed to the tubular element 19 are profiles 29 defining three pairs of generally flat surfaces 31A, 31B; 33A, 33B and 35A, 35B. The two surfaces of each pair are joined toward the axis A—A where they converge to form a sort of very open V. The angle formed by the pairs of flat surfaces is approximately 130° in the example shown. The moveable member can be adjusted to place it in the best position for the characteristics of the roll, for example its density, diameter and other physical parameters.

Fixed to the tubular element 19 is a sprocket 37 carrying a drive chain 39 which takes its power from another sprocket 41 mounted on the output shaft of a motor/gearbox unit 43. The latter is supported by the side wall 25 and supplies the rotary movement to the moveable member 17. The chain 39 also passes around two other idle sprockets, schematically illustrated in FIG. 2 where they are numbered 45 and 47, one of which can be adjusted to tension said chain. Alternatively, the rotation may be imparted by a motor directly coaxial with the tubular element 19.

In the example illustrated, at a certain point along the rolling surface 11 is an optical detector 51 consisting for example of an optical transmitter/receiver arrangement, which serves to detect the passage of individual rolls R down the rolling surface. The optical detector 51 is interfaced with a control unit 53 to which the motor/gearbox unit 43 and a position sensor 55 associated with the moveable member 17 are also connected. The position sensor 55 may be of any type suitable for the purpose. Possible examples are a magnetic microswitch as schematically illustrated in the drawings, or a photocell, or even an encoder, this last particularly where high precision is required.

The manner in which the device described thus far operates is as follows:

Assuming the moveable member to be temporarily set in the angular position shown in FIG. 2, when the detector 51 detects the passage of a roll R, the signal it produces starts, acting through the control unit 53 and the actuator 43, the moveable member 17 rotating about the axis A—A. Thus, when the roll R bumps against the retaining surface, for example in this case the surface 31A, the impact occurs between two parts which are both moving in the same direction, which softens the impact. Furthermore, as soon as the roll has passed beneath the second surface 31B of the pair of surfaces 31A, 31B, this second surface continues to descend until its distal edge (meaning the edge furthest from the axis A—A) is at a height such as to prevent the roll R bouncing backwards. The result is a containment volume in which the roll is trapped between the two surfaces 31A, 31B and the rolling surface 11. Inside this containment volume the roll may possibly continue to bump backwards and forwards until it has lost all or part of its kinetic energy. The rotational movement of the moveable member may stop at this point or may continue at the same angular velocity or at a different velocity, depending on what operating conditions are required, such as for example data coming from the rewinder upstream or from the downstream section, such as a gluing machine.

At the right moment the angular position of the moveable member will be such that the distal edge of the surface 31A is high enough up to release the roll, which will then continue its movement toward the downstream station. The rotational movement of the moveable member will continue until this member is in position to receive the next roll. The movement can be stopped temporarily or its velocity be modified to suit operating conditions. Either way, the position sensor 55 can still supply the unit 53 with correct information on the angular position of the moveable member.

As mentioned earlier, the control of the movement of the moveable member 17 may also be performed directly by signals coming from the rewinder, rather than by the signal generated by the detector 51, since the arrival of roll is obviously consequential upon the expulsion of that roll from the winding cradle defined by the cylinders 1, 3, 5. The expulsion command can therefore be used to control the movement of the moveable member 17, optionally with a delay which may be programmable to take account of the greater or lesser rolling speed of the roll on the surface 11, which depends on numerous factors including the initial speed of expulsion and the specific weight of the roll itself.

It will be understood that the drawing shows only one possible embodiment of the invention, which can be varied in its shapes and arrangements without departing from the scope of the concept on which the invention is based. Any reference numbers in the claims are purely for the purpose of facilitating the reading of the claims in the light of the description and drawings and do not limit the scope of protection.

The invention claimed is:

1. A device for controlling discharge of rolls from a rewinder, comprising: a rolling surface on which the rolls roll as said rolls leave said rewinder; a member able to move about an axis thereof, said axis being parallel to said rolling surface and perpendicular to a direction of discharge of the rolls from said rewinder; and an actuator for controlling movement of said member; wherein during operation, said member always rotates in a same direction about said axis, said member includes at least two roll retaining surfaces defining, with said rolling surface, a roll containing zone; and said member rotates in a direction to cause said rolls to pass between said axis and said rolling surface.

2. Device according to claim 1, wherein said roll containing zone is upwardly delimited by said two retaining surfaces of said member and downwardly delimited by said rolling surface, the roll being retained between said two retaining surfaces and said rolling surface.

3. Device according to claim 1 wherein said axis about which said member moves is arranged above said rolling surface.

4. A device for controlling discharge of rolls from a rewinder, comprising: a rolling surface on which the rolls roll as said rolls leave said rewinder; a member able to move about an axis thereof, said axis being parallel to said rolling surface and perpendicular to a direction of discharge of the rolls from said rewinder; and an actuator for controlling movement of said member; wherein during operation, said member always rotates in a same direction about said axis, and said member includes at least two roll retaining surfaces defining, with said rolling surface, a roll containing zone, wherein a first surface of said at least two roll retaining surfaces is positioned to form a bump surface for a roll coming from the rewinder and a second surface of said at least two roll retaining surfaces is arranged to obstruct backward movement of the roll upon the roll bouncing off said first surface.

5. A device for controlling discharge of rolls from a rewinder, comprising: a rolling surface on which the rolls roll as said rolls leave said rewinder; a member able to move about an axis thereof, said axis being parallel to said rolling surface and perpendicular to a direction of discharge of the rolls from said rewinder; and an actuator for controlling movement of said member; wherein during operation, said member always rotates in a same direction about said axis, said member includes at least two roll retaining surfaces defining, with said rolling surface, a roll containing zone; and means for detecting arrival of a roll on said rolling surface and wherein said actuator is controlled in such a way as to set said member in motion about said axis before said roll contacts the member.

6. A device for controlling discharge of rolls from a rewinder, comprising: a rolling surface on which the rolls roll as said rolls leave said rewinder; a member able to move about an axis thereof, said axis being parallel to said rolling surface and perpendicular to a direction of discharge of the rolls from said rewinder; and an actuator for controlling movement of said member; wherein during operation, said member always rotates in a same direction about said axis, and said member includes at least two roll retaining surfaces defining, with said rolling surface, a roll containing zone; means for detecting arrival of a roll on said rolling surface and wherein said actuator is controlled in such a way as to set said member in motion about said axis before said roll contacts the member, wherein said member is controlled in such a way that when the roll contacts a first surface of said at least two roll retaining surfaces, another surface of said at least two roll retaining surfaces is in a position to obstruct backward movement of the roll caused by the roll bouncing off the first surface.

7. Device according to claim 4 or 6, wherein said at least two roll retaining surfaces define two convergent planes forming an obtuse angle in which the roll containing zone is present.

8. Device according to claim 7, wherein said planes define an angle of between 100° and 150°.

9. Device according to claim 1, wherein said member has a plurality of pairs of said roll retaining surfaces.

10. Device according to claim 9, wherein said member has three pairs of said roll retaining surfaces.

11. Device according to claim 1, wherein said actuator is an electric motor.

12. A device for controlling discharge of rolls from a rewinder, comprising: a rolling surface on which the rolls roll as said rolls leave said rewinder; a member able to move about an axis thereof, said axis being parallel to said rolling surface and perpendicular to a direction of discharge of the rolls from said rewinder; and an actuator for controlling movement of said member; wherein during operation, and said member always rotates in a same direction about said axis, and said member includes at least two roll retaining surfaces defining, with said rolling surface, a roll containing zone, wherein said member is adjustable to modify distance between the axis and the rolling surface.

13. A device for controlling discharge of rolls from a rewinder, comprising: a rolling surface on which the rolls roll as said rolls leave said rewinder; a member able to move about an axis thereof, said axis being parallel to said rolling surface and perpendicular to a direction of discharge of the rolls from said rewinder; and an actuator for controlling movement of said member; wherein during operation, said member always rotates in a same direction about said axis, said member includes at least two roll retaining surfaces defining, with said rolling surface, a roll containing zone; and a detector for detecting movement of a roll from a predefined position along the rolling surface, said detector being connected to a control unit which controls said member as a function of a detection signal of said detector.

14. Device according to claim 13, wherein said member is provided with a position sensor connected to said control unit.

15. A device for controlling discharge of rolls from a rewinder, comprising: a rolling surface on which the rolls roll as said rolls leave said rewinder; a member able to move about an axis thereof, said axis being parallel to said rolling surface and perpendicular to a direction of discharge of the rolls from said rewinder; and an actuator for controlling movement of said member; wherein during operation, said member always rotates in a same direction about said axis, and said member includes at least two roll retaining surfaces defining, with said rolling surface, a roll containing zone, wherein said actuator is operated by a control unit having an interface with said rewinder as a function of signals coming from said rewinder and relating to discharging of the rolls from the rewinder.

16. A rewinder for producing said rolls of wound web material incorporating the device according to claim 1, 2, 3, 4, 5, 6, 9, 10, 11, 12, 13, 14 or 15.

17. A rewinder for producing said rolls of wound web material incorporating the device according to claim 7.

18. The rewinder according to claim 17, wherein the planes define an angle of between 100° and 150°.

19. A device for controlling discharge of rolls from a rewinder, comprising: a rolling surface on which the rolls roll as said rolls leave said rewinder, said rolling surface extending along a roll advancing path; a member able to move about an axis thereof, said axis being parallel to said rolling surface and perpendicular to a direction of discharge of the rolls from said rewinder; and an actuator for controlling movement of said member; wherein during operation, said member always rotates in a same direction about said axis, and said member includes at least two roll retaining surfaces defining, with said rolling surface, a roll containing zone, and wherein said roll advancing path extends between said rolling surface and said axis whereby said rolls roll on said rolling surface beneath the axis of the member in such a way that the roll passes beneath said axis.

20. A device for controlling discharge of rolls from a rewinder, comprising: a rolling surface on which the rolls roll as said rolls leave said rewinder; a member able to move about an axis thereof, said axis being parallel to said rolling surface and perpendicular to a direction of discharge of the rolls from said rewinder; and an actuator for controlling movement of said member; wherein during operation, said member always rotates in a same direction about said axis, and said member includes at least two roll retaining surfaces defining, with said rolling surface, a roll containing zone, and wherein said member is arranged entirely above said rolling surface.

21. Device according to claim 19 or 20, wherein a first surface of said at least two roll retaining surfaces is positioned to form a bump surface for a roll coming from the rewinder and a second surface of said at least two roll retaining surfaces is arranged to obstruct backward movement of the roll upon the roll bouncing off said first surface.

22. Device according to claim 19 or 20, further comprising means for detecting arrival of a roll on said rolling surface and wherein said actuator is controlled in such a way as to set said member in motion about said axis before said roll contacts the member.

23. Device according to claim 22, wherein said member is controlled in such a way that when the roll contacts a first surface of said at least two roll retaining surfaces, another surface of said at least two roll retaining surfaces is in a position to obstruct backward movement of the roll caused by the roll bouncing off the first surface.

24. Device according to claim 21, wherein said at least two roll retaining surfaces define two convergent planes forming an obtuse angle in which the roll containing zone is present.

25. Device according to claim 22, wherein said at least two roll retaining surfaces define two convergent planes forming an obtuse angle in which the roll containing zone is present.

26. Device according to claim 23, wherein said at least two roll retaining surfaces define two convergent planes forming an obtuse angle in which the roll containing zone is present.

27. Device according to claim 19 or 20, wherein said member is adjustable to modify distance between the axis and the rolling surface.

28. Device according to claim 19 or 20, further comprising a detector for detecting movement of a roll from a predefined position along the rolling surface, said detector being connected to a control unit which controls said member as a function of a detection signal of said detector.

29. Device according to claim 28, wherein said member is provided with a position sensor connected to said control unit.

30. Device according to claim 19 or 20, wherein said actuator is operated by a control unit having an interface with said rewinder as a function of signals coming from said rewinder and relating to discharging of the rolls from the rewinder.

* * * * *